United States Patent [19]

Weyhausen

[11] 3,999,670

[45] Dec. 28, 1976

[54] EXCAVATOR HAVING A SWIVEL JOINT BETWEEN THE MAIN ARM AND THE JIB

[76] Inventor: Hinrich Weyhausen, Stedinger Str. 324, 287 Delmenhorst, Germany

[22] Filed: Mar. 8, 1968

[21] Appl. No.: 711,550

[52] U.S. Cl. ..... 214/138 R; 37/103

[51] Int. Cl. ..... E02f 3/32

[58] Field of Search ..... 214/138, 140, 768; 37/103, 118; 46/40

[56] References Cited

UNITED STATES PATENTS

| | | | |
|---|---|---|---|
| 2,847,134 | 8/1958 | Slate | 214/138 |
| 3,027,026 | 3/1962 | Couguet | 214/138 |
| 3,149,737 | 9/1964 | Guinot | 214/138 |
| 3,197,049 | 7/1965 | Schwing | 214/138 |
| 3,231,116 | 1/1966 | Powell | 214/138 |

FOREIGN PATENTS OR APPLICATIONS

| | | | |
|---|---|---|---|
| 996,549 | 6/1965 | United Kingdom | 37/118 |
| 1,038,636 | 8/1966 | United Kingdom | 214/138 |
| 1,049,307 | 11/1966 | United Kingdom | 37/103 |

*Primary Examiner*—Robert E. Pulfrey
*Assistant Examiner*—Clifford D. Crowder

[57] ABSTRACT

An excavator comprising a main arm, a jib, a crank arm and a bucket. A swivel joint connects the main arm and the jib. The jib can be turned out of the plane of the main arm and thus be inclined sideways. Digging of an embankment at an oblique angle and digging road ditches with a gradient are thus permitted.

1 Claim, 4 Drawing Figures

EXCAVATOR HAVING A SWIVEL JOINT BETWEEN THE MAIN ARM AND THE JIB

The invention relates to an excavator, especially a hydraulic excavator, with a main arm arranged on the top of the excavator to which is connected a jib together with a cranked arm.

In the construction of excavators, it has been endeavoured to an increasing extent to make implements which can be used as extensively as possible, in order to make available to the construction companies economically operating machines. Hydraulic excavators with crank arm jibs already largely fulfill this requirement, since they can be easily and uniformly operated with a ditching shovel, high level shovel and grab-bucket. However, there are operations which have previously been reserved only for a hydraulic excavator with a rotatable telescopic arm or grader, as for example digging in embankments at an oblique angle or the digging of road ditches with a gradient.

The object of the invention is to provide an additional appliance for an excavator of the said kind, which increases its range of application and with which in particular the above-mentioned special operations can be carried out.

According to the invention this object has been achieved in that the main arm and jib arm are connected by a swivel joint with its axis running in or parallel to the central plane of the jib arm.

With this arrangement the jib arm can be turned out of the plane of the main arm, and thus be inclined sideways, through which numerous possibilities of application are opened, such as are indicated below.

According to a further development of the invention, the swivel joint may be moved hydraulically. In this case in particular, a hydraulic adjusting cylinder may be arranged on each side of the swivel joint.

Figure 3:
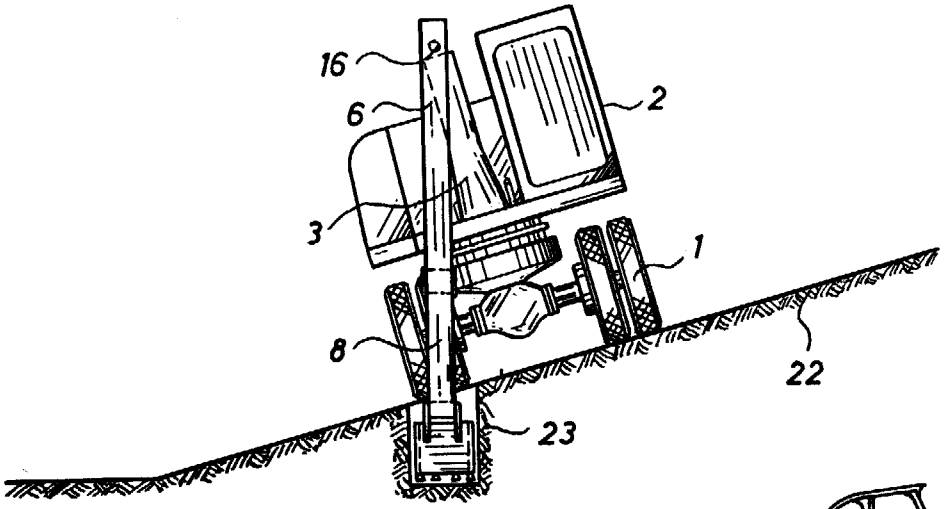
Figure 4:
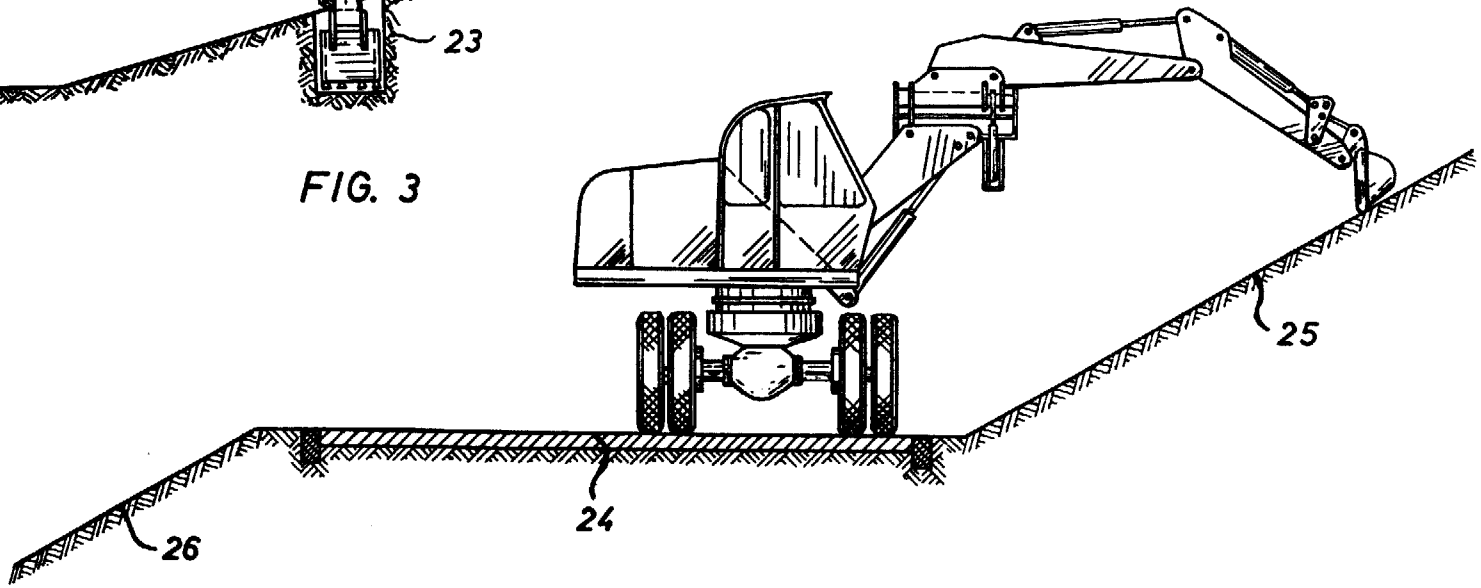

An embodiment of the invention, from which further inventive features will be apparent from the drawing. In this, FIG. 1 shows a hydraulic excavator in side elevation with a swivel joint between the main arm and the jib arm, FIG. 2 shows the swivel joint on an enlarged scale seen from behind, and FIGS. 3 and 4 show the excavator with two new applications made possible by the swivel joint.

Figure 1:
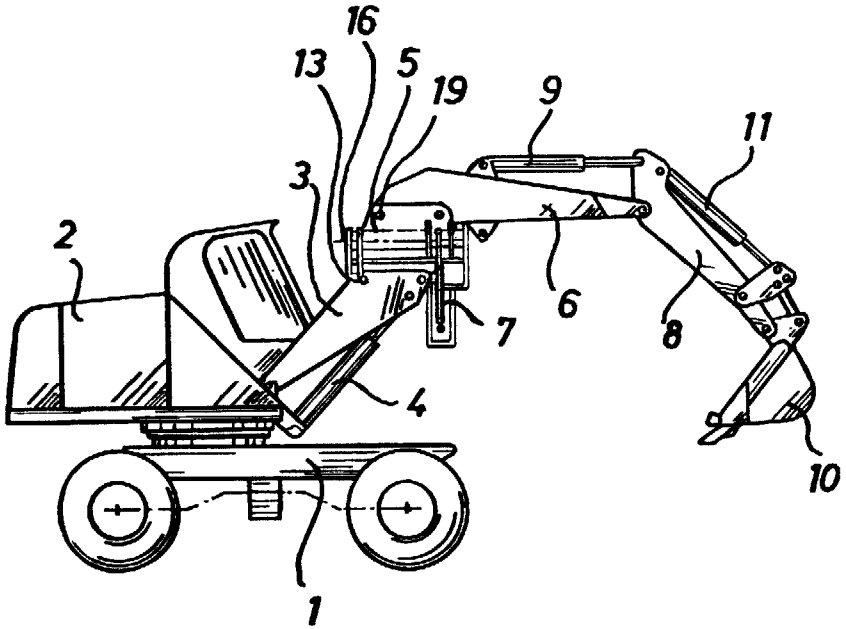

In FIG. 1 a hydraulic excavator is shown with the chassis 1 and the swivelable top part 2. The main arm 3 is moved in known manner by the lifting cylinder 4. The jib arm 6 is fixed to the main arm 3 with interposition of a swivel joint 5. It makes the lifting movement like the main arm, but can be adjusted, so that it slopes to the right and left of this, by the adjusting cylinders 7. Finally the jib arm carries, in known manner, the crank arm 8, which is actuated by the crank cylinder 9. The crank arm carries the ditching shovel 10, which is moved by the tilting cylinder 11.

Figure 2:
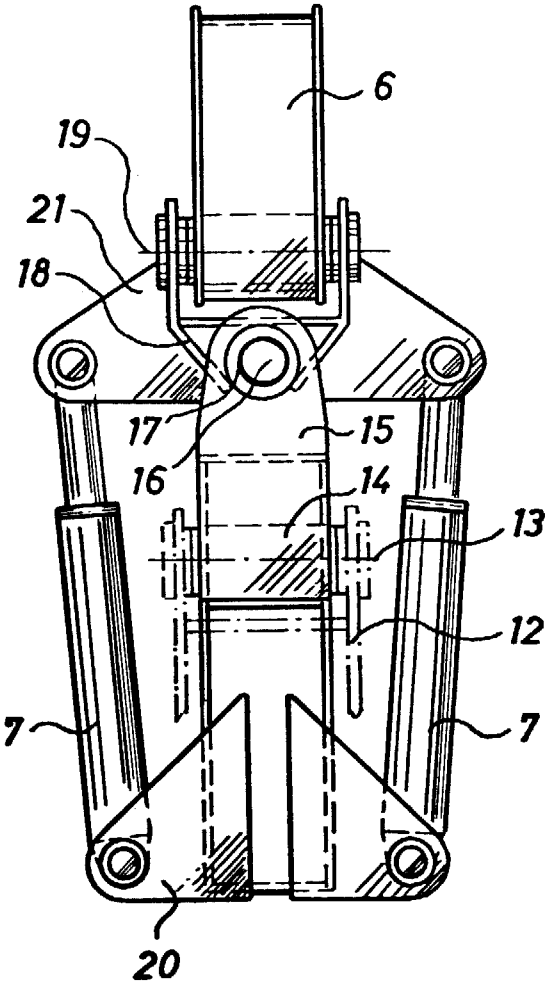

In FIG. 2 the swivel joint 5 is shown on a larger scale, viewed from behind. A pair of side plates of the main arm 3 are denoted by 12. Jib arm 6 is normally fixed between this pair of side plates by means of bolt 13. In the example shown, the swivel joint 5 is inserted here. The lower part 14 of the swivel joint is pivotably secured to the main arm with the bolt 13. Between a pair of end cover plates 15 of the swivel joint is fitted the housing bush 17 rotatable around the axle 16. On this bush are secured a pair of bent plates 18 for the reception of the jib 6, which is held by two bolts 19 between these bent plates.

Two adjusting cylinders 7 are pivotably secured to a pair of plate members 20 and a swivel plate 21, the pair of plate members 20 being secured to the bottom portion of the swivel joint and the swivel plate 21 being secured to the jib arm. The power cylinders can thus turn the jib arm relative to the main arm by 45° to the right and to the left or adjust it obliquely.

In FIG. 3 the excavator according to FIG. 1 is seen from the front, positioned on a slope 22. The excavator with its parts 1 to 4 stands at the same angle as the slope. By means of the swivel joint, the jib 6 with the crank arm 8 are turned so for round the axle 16, that these parts stand vertically. In this way a trench or ditch 23 can be dug vertically with the crank arm shovel.

In FIG. 4, the excavator stands on a road 24, from whence the upper and lower slopes 25 and 26 can be removed by it. For this purpose wide trench shovels are used. When curves or obstacles are encountered in the road it is always possible, by means of the swivel joint, when the arm is inclined to the slope, in the plan view, to adjust the cutting edge of the shovel so that it is parallel to the slope and by operating the crank arm to dig out the slope in the plane thereof.

The swivel joint offers numerous further possible applications. The excavator can be driven along on the side of the road with a shovel in an oblique position so that it makes the ditch in the road with the desired gradient like a grader. At the same time it can load the excess wayside material, each time the shovel is filled and, in case at some places the driving power is not sufficient for stripping, the stripping or levelling can be effected by the crank arm operation from the upright position.

In the case of a ditch dug on level ground, the excavator can produce sloping banks by right and left inclined positions of the jib arm and consequently produce trapezoidal ditches of different shape without the use of a trapezoidal shovel.

The principle of rotation of the jib arm is also correspondingly applicable in the case of a mechanically driven excavator, for example a stripping shovel.

I claim:

1. In an excavator comprising in combination, a chassis, a carriage mounted for movement about a vertical axis on said chassis, a main arm mounted for pivotal movement about a horizontal axis on said carriage, a jib arm, means to mount one end of said jib arm on said main arm, a crank arm pivotally mounted on the other end of said jib arm, a bucket pivotally mounted on said crank arm, the improvement wherein said means for mounting said one end of said jib arm on said main arm comprises: a swivel joint between said main arm and said one end of said jib arm, a pair of side plates secured to said main arm, a bolt extending through said side plates in said swivel joint, a pair of end cover plates on said swivel joint, an axle secured between said cover plates, a housing bush rotatable about said axle, a pair of bent plates secured to said bush, a pair of bolts extending through said bent plates and said one end of said jib arm, a swivel plate secured to said one end of said jib arm, a pair of plate members secured to the bottom portion of said swivel joints, a pair of power cylinders pivotally secured between said swivel plate and said plate members, whereby said jib arm may be pivoted about said axle relative to said main arm.

* * * * *